US006297888B1

(12) United States Patent
Noyes et al.

(10) Patent No.: US 6,297,888 B1
(45) Date of Patent: Oct. 2, 2001

(54) AUTOMATIC ALIGNMENT OF PRINT HEADS

(75) Inventors: Steven Noyes, Fountain Valley; Hiromitsu Hirabayashi; Akitoshi Yamada, both of Irvine, all of CA (US)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/071,111

(22) Filed: May 4, 1998

(51) Int. Cl.[7] ..... B41B 15/00; B41J 15/00; B41J 29/393; B41J 29/38; B41J 23/00

(52) U.S. Cl. ..... 358/1.9; 358/1.1; 358/1.13; 358/1.15; 358/1.16; 358/1.17; 347/19; 347/14; 347/37

(58) Field of Search ..... 358/468, 444, 358/404, 403, 400, 1.15, 1.13, 1.1, 1.9, 1.16, 1.17; 347/19, 14, 37

(56) References Cited

U.S. PATENT DOCUMENTS 5,530,460 6/1996 Wehl ..... 347/19

6,089,766 * 7/2000 Yamada et al. ..... 400/120.09

FOREIGN PATENT DOCUMENTS 90-76480 3/1997 (JP) .

* cited by examiner

*Primary Examiner*—Edward Coles
*Assistant Examiner*—Twyler Lamb
(74) *Attorney, Agent, or Firm*—Fitzpatrick, Cella, Harper & Scinto

(57) ABSTRACT

Improved techniques for measuring misalignment between multiple print heads, or between forward and reverse printing for the same print head. Adverse effects of ink bleeding, paper cockling and other ink ejection effects are reduced by superimposingly printed alignment patterns in which less than all pixels of printed portions of the patterns are filled in. Carriage ringing and overshoot effects are reduced by printing the alignment patterns in multiple passes, and preferably with an offset in carriage starting location for each pass. Improved detection of darkest density regions of the superimposingly printed alignment pattern is obtained through detections based on differences between densities rather than absolute values of measured densities.

102 Claims, 12 Drawing Sheets

| REGION | DENSITY READINGS | AVERAGE | DIFFERENCE |
|---|---|---|---|
| I | $D_{I1}, D_{I2}, \ldots, D_{Ij}$ | $\bar{D}_I$ | |
| II | $D_{II1}, D_{II2}, \ldots, D_{IIj}$ | $\bar{D}_{II}$ | $\bar{D}_I - \bar{D}_{IV} = \Delta_A$ |
| III | $D_{III1}, D_{III2}, \ldots, D_{IIIj}$ | $\bar{D}_{III}$ | $\bar{D}_{II} - \bar{D}_V = \Delta_B$ |
| IV | $D_{IV1}, D_{IV2}, \ldots, D_{IVj}$ | $\bar{D}_{IV}$ | $\bar{D}_{III} - \bar{D}_{VI} = \Delta_C$ |
| V | $D_{V1}, D_{V2}, \ldots, D_{Vj}$ | $\bar{D}_V$ | |
| VI | $D_{VI1}, D_{VI2}, \ldots, D_{VIj}$ | $\bar{D}_{VI}$ | |

FIG. 10

AUTOMATIC ALIGNMENT OF PRINT HEADS

BACKGROUND OF THE INVENTION

1. Field of the Invention

The present invention relates to printers such as ink jet printers having up to multiple print heads, and more particularly to alignment of one head to others thereof such that printout for each print head superimposes accurately and with good quality.

2. Description of the Related Art

Printers such as ink jet printers have become an extremely popular format for achieving high quality computer printout at low cost. Such printers print an image on a recording medium by uni-directional or reciprocal back-and-forth movement of one or more print heads across the recording medium. In the case of ink jet printers, a printed image is formed by ejecting small ink droplets from a print head in predetermined patterns onto the recording medium. The print head is mounted on a moveable carriage which provides right and left reciprocal movement at high scanning speeds across the width of the recording medium, while the recording medium is slowly fed in the lengthwise direction.

Recently-introduced printers, particularly ink jet printers, have multiple print heads, such as two or more print heads mounted on the reciprocating carriage. The print heads may be identical to each other, such as dual black or dual color print heads which increase black and white or color printout speeds by up to a factor of two. Alternatively, the print heads may differ from each other, such as a black print head paired with a color print head which provides good color reproduction without sacrificing print speed for black and white documents. As a further example, some ink jet printers are equipped with one full color print head paired with a photographic-density color print head, so as to achieve high quality photographic-like printout.

One complication introduced by providing printers with multiple print heads is the need to align printout for one of the multiple print heads to all others of the multiple print heads. Without alignment, mechanical manufacturing tolerances would cause printout from one print head to be mismatched in either or both of the vertical or horizontal direction relative to printout from others of the print heads.

Moreover, printout from even a single print head often differs when printing in forward and reverse directions. Thus, alignment of a single print head to itself is sometimes needed, so as to align printout in the forward direction to printout in the reverse direction.

Some existing multiple head ink jet printers utilize a manual alignment technique in which predetermined patterns are printed and the computer user is asked to respond to questions concerning quality and appearance of the printout. Such techniques are not generally satisfactory, in that they cause needless user confusion, result in inconsistent alignment accuracy, and inevitably complicate use of the printer.

The assignee of the present application has recently described a technique for automatic alignment of multiple print heads in an ink jet printer, in which an alignment sensor is mounted on the carriage together with the multiple print heads. According to this technique, automatic alignment is achieved through printout of predetermined patterns, automatic sensing of printout results, and calculation of alignment parameters. See U.S. application Ser. No. 08/901,560, "Auto-Alignment System For A Printing Device", the contents of which are incorporated herein by reference as if set forth in full.

In one example of an automatic alignment procedure described in application Ser. No. 08/901,560, each print head is caused to print a highly repetitive pattern, with the phase of the pattern (i.e., the starting position thereof) being shifted gradually for one print head relative to the other. The superimposed printout of the two print heads exhibits a correspondingly varying density signature, which varies in correspondence to the gradual phase shift, and which is sensed by the alignment sensor. Perfect alignment between the print heads is that point at which the printed density pattern is lightest, as sensed by the alignment sensor. This technique is explained in more detail in connection with FIG. 1.

Shown in FIG. 1 is the alignment pattern printed by each of print heads A and B, together with the result of superimposition of the alignment patterns, so as to align print heads A and B in the horizontal direction. As shown in FIG. 1, alignment pattern 11 for print head A consists of repetitive printouts of vertical columns of pixels 12 arranged three columns wide, followed by three columns of no pixels (i.e., white space on a paper recording medium). Likewise, alignment pattern 14 for print head B consists of repetitive patterns of three vertical columns of pixels 15 followed by three blank columns. However, for print head B, at each of areas I through VI, the starting position of the pattern is shifted horizontally by one pixel. Thus, as shown at area II, the starting location of pattern 15 is gradually shifted rightwardly by one horizontal pixel 16. The width of each region is approximately 60 patterns wide.

The result of superimposition of the alignment patterns is shown at 17. In region I, the patterns from print head A and print head B overlap completely, resulting in a printed output 19 that appears as dark vertical lines three pixels wide followed by bright white lines also three pixels wide. At each of regions II through VI, the alignment patterns for print head A and print head B overlap to increasingly lesser extents. In particular, at region IV, the alignment pattern does not overlap at all, resulting in a printed output which appears to be solid black space. Because approximately 60 patterns are printed in each region, an alignment sensor 21, whose alignment face is approximately 40 or 50 pixels wide, would sense the pattern in area I as having a lightest printed density relative to the pattern in area IV which would be sensed as having a darkest printed density. Perfect horizontal alignment between the print heads would then be calculated as in region I.

In like manner, alignment between the print heads in the vertical direction can be obtained through printout of vertically-arranged repetitive patterns with the phase of the pattern for one print head being shifted gradually relative to the other. Such a pattern is illustrated in FIG. 2.

The alignment technique above is extremely advantageous since it is entirely automatic and provides good alignment results without the need for user intervention. On the other hand, and particularly when alignment is performed using low-grade paper as the recording medium, practical difficulties limit the ability of such an alignment technique to provide alignment down to ±1 pixel.

In particular, as shown at the inset in FIG. 1A, when printing alignment patterns on low grade paper, ejected ink bleeds from the ideal borders of the alignment patterns into adjacent regions. For example, as seen at 22, ink from an ideal alignment pattern bleeds into regions which should remain white, thereby decreasing the ability to distinguish between a lightest superimposed pattern and a darkest superimposed pattern.

Furthermore, as shown at 19 in FIG. 1, because alignment patterns for head A and head B are completely superimposed, region 19 receives 200% ink quantities. Such a large amount of ink in so small an area causes cockling or other warping of the paper recording medium resulting in an inaccurately printed alignment pattern.

FIG. 3 shows another difficulty in producing accurate printouts of alignment patterns, relating to variation in carriage speed during printout. Shown in FIG. 3 is a graphical representation of carriage speed versus horizontal position across the recording medium. As shown in FIG. 3, the carriage speed ramps up from a stand still position toward a target scanning speed, but exhibits overshoot and other ringing properties which are most significant at the beginning of the scan but which continue to a smaller degree even after the target scanning speed has been reached at 31. Since print heads A and B are both mounted on the same carriage but with a horizontal offset therebetween, it is clearly necessary for the carriage to move horizontally in order for print head B to print superimposingly over the same position as printed by print head A. Thus, when print head A prints at position X, the carriage may be moving at slightly higher speed 32 than the target scanning speed 31. Later, when print head B prints at position X, the carriage may be moving at a slightly lower speed 33 than the target scanning speed 31. This difference in carriage speed when printing the alignment pattern for head A relative to the alignment pattern for head B leads to further inaccuracies in the superimposed alignment pattern result, and leads to further decreases in alignment accuracy.

Finally, alignment accuracy is also affected by the ability of sensor 21 to distinguish between a darkest printed density area and a lightest printed density area. However, as shown in FIG. 4, the difference Δ between a darkest density area and a lightest density area is often quite small. FIG. 4 is a graph showing variation in printed pattern density as sensor 21 scans across regions I to VI. The density range shown in FIG. 4 varies from around 0 to 255, and the readings in FIG. 4 are obtained by density conversion of an analog-to-digital converted output from sensor 21 as it scans across each of regions I through VI. As can be seen in FIG. 4, alignment sensor output for region I is different than that for region IV (which represents perfect alignment) by only an amount Δ which may be around 15 to 20 counts out of a possible 256. Much less of a difference is evident between regions III through V. Altogether, the small value of A, and the small change from region to region, make it difficult to detect which region represents the best alignment. This difficulty is compounded when the effects of noise are superimposed on the graph shown in FIG. 4.

SUMMARY OF THE INVENTION

It is an object of the invention to provide improvements in alignment accuracy by increasing the accuracy of the printed alignment pattern, by accommodating ringing and overshoot in carriage speed, and by accurately detecting which of plural regions is the lightest printed density region (and consequently the best alignment) even in the presence of noise on alignment sensor output.

In one aspect, the invention provides improved alignment through printout of alignment patterns that involve only 50% pattern printout rather than 100% ejection. In this aspect, the alignment patterns are preferably not 100% ink ejections for each print head, but rather are lower percentages such that not all pixels in an alignment pattern are printed. In its most preferred form, where two heads are to be aligned, the alignment patterns are composed of checkerboard patterns wherein every other pixel is on. Especially in a case where the print heads to be aligned are ink jet print heads, and patterns are printed by ink ejection, printing patterns at less than 100% ink ejection reduces ink bleed and paper cockling, leading to better alignment patterns and more accuracy alignment results.

By virtue of this arrangement, since less than all pixels are printed for each alignment pattern, bleeding around the edges of the pattern is reduced even on low quality paper. Moreover, even when the alignment pattern for each print head is superimposed, not too much recording material (such as ink) is put down at any one area of the paper, reducing the possibility of paper cockling.

Preferably, vertical alignment is performed first followed by horizontal alignment. If vertical alignment is performed first, then printed pixels in the alignment pattern for one head can accurately dovetail into interstices in the printed pattern of other heads, even further reducing the possibility of causing paper cockling by applying too much recording material in any one localized area.

According to another aspect of the invention, the effects of non-constant carriage speed such as by ringing or other overshoot are reduced by printing each alignment pattern in multiple passes rather than in one pass, and preferably with an offset in carriage starting position between each pass. For example, rather than printing an alignment pattern for horizontal alignment in a single scan of the print heads across a recording medium, the alignment pattern may be printed in two or more passes (such as seven passes). The carriage starting position may be shifted slightly between each pass. Preferably, the shift amount corresponds to one cycle of the carriage speed ringing pattern divided by the number of multiple passes. Because the alignment pattern is printed with multiple passes, possibly with an offset between each pass, it is possible to distribute the effect of ringing and other carriage speed inconsistencies throughout the alignment pattern rather than concentrating these effects at one location.

In another aspect, the invention provides for improved detection of alignment pattern density by making detections based on differences between densities rather than absolute values of density. For example, in a situation where a printed alignment pattern results in six different printed density regions, it is known that the ideal density will vary cyclically from a lightest to a darkest and back to a lightest in six steps, with the darkest region being separated from the lightest region by three regions (i.e., half the number of regions for two heads). In this situation, differences of densities separated by three regions are obtained. The difference having the largest value represents the largest density change, by which it can be determined that the lightest and/or darkest regions correspond to this difference. Accordingly, accuracy in the determination of the lightest or darkest region can be improved.

This brief summary has been provided so that the nature of the invention may be understood quickly. A more complete understanding of the invention can be obtained by reference to the following detailed description of the preferred embodiment thereof in connection with the attached drawings.

BRIEF DESCRIPTION OF THE DRAWINGS

FIG. 10 is a view for explaining how to calculate misalignment.

DETAILED DESCRIPTION OF THE PREFERRED EMBODIMENT

Figure 5:
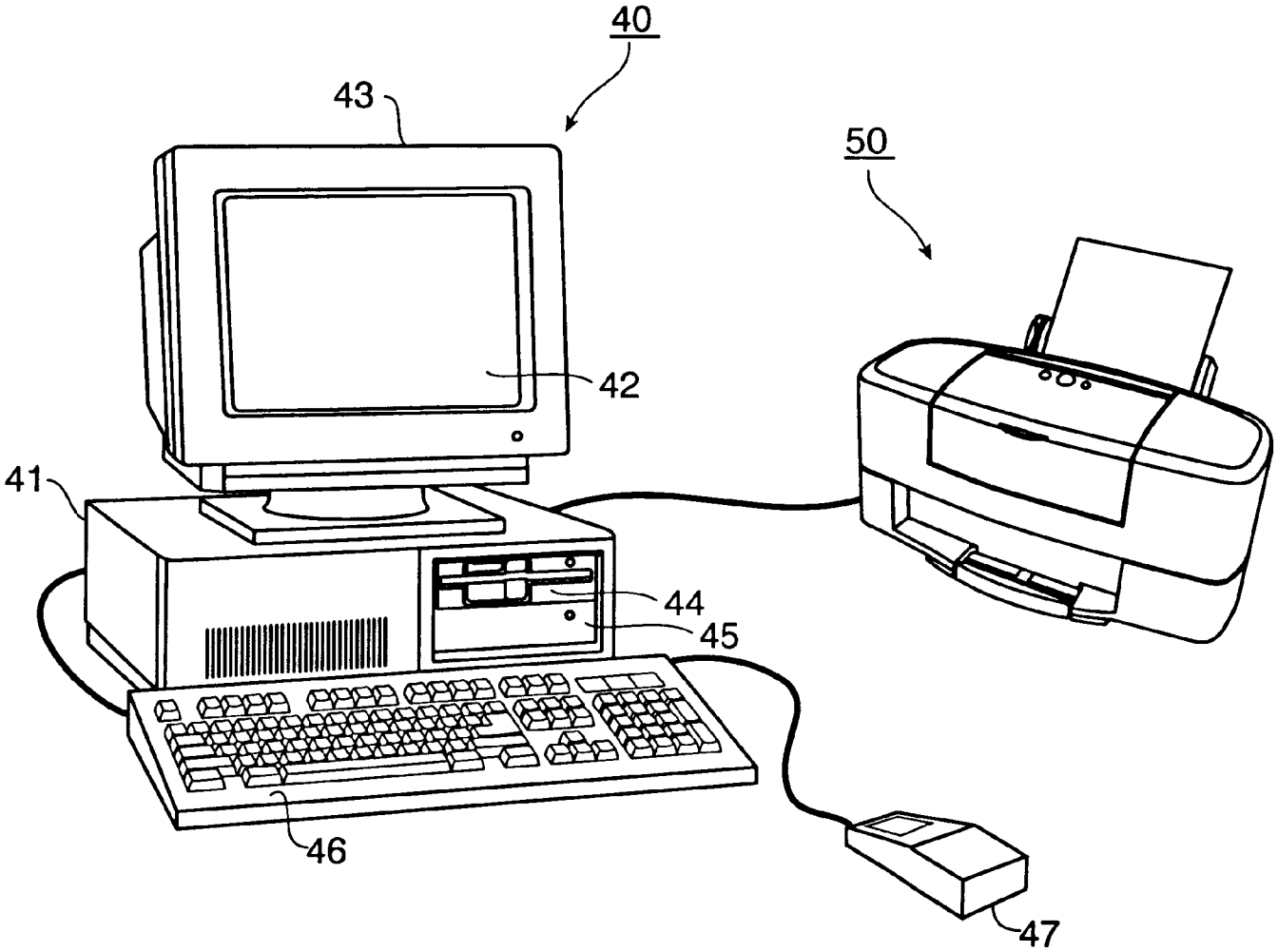
FIG. 5 is a perspective view of computing equipment and a printer used in connection with the present invention.

FIG. 5 is a view showing the outward appearance of computing equipment 40 and printer 50 used in connection with the practice of the present invention. Computing equipment 40 includes host processor 41 which comprises a personal computer (hereinafter "PC"), preferably an IBM PC-compatible computer having a windowing environment such as Microsoft Windows 95. Provided with computing equipment 40 are display 43 including display screen 42, keyboard 46 for entering text data and user commands, and pointing device 47. Pointing device 47 preferably comprises a mouse for pointing and for manipulating objects displayed on display screen 42.

Computing equipment 40 includes a computer-readable memory medium such as computer disk 45 and/or floppy disk drive 44. Floppy disk drive 44 provides a means whereby computing equipment 40 can access information, such as data, application programs, etc. stored on removable memory media. A similar CD-ROM interface (not shown) may be provided for computing equipment 40 through which computing equipment 40 can access information stored on removable CD-ROM media.

Printer 50 is preferably a color ink jet printer which forms images by ejecting droplets of ink onto a recording medium such as paper or transparencies or the like. One suitable printer is described in application Ser. No. 08/972,139, "Ejection Tray For A Printer", the contents of which are incorporated herein by reference as if set forth in full. The invention is usable with other printers, however, such as dot matrix printers, where alignment of one head to others thereof is desired, or where alignment of forward to reverse printing by one head to itself is desired.

Figure 6:
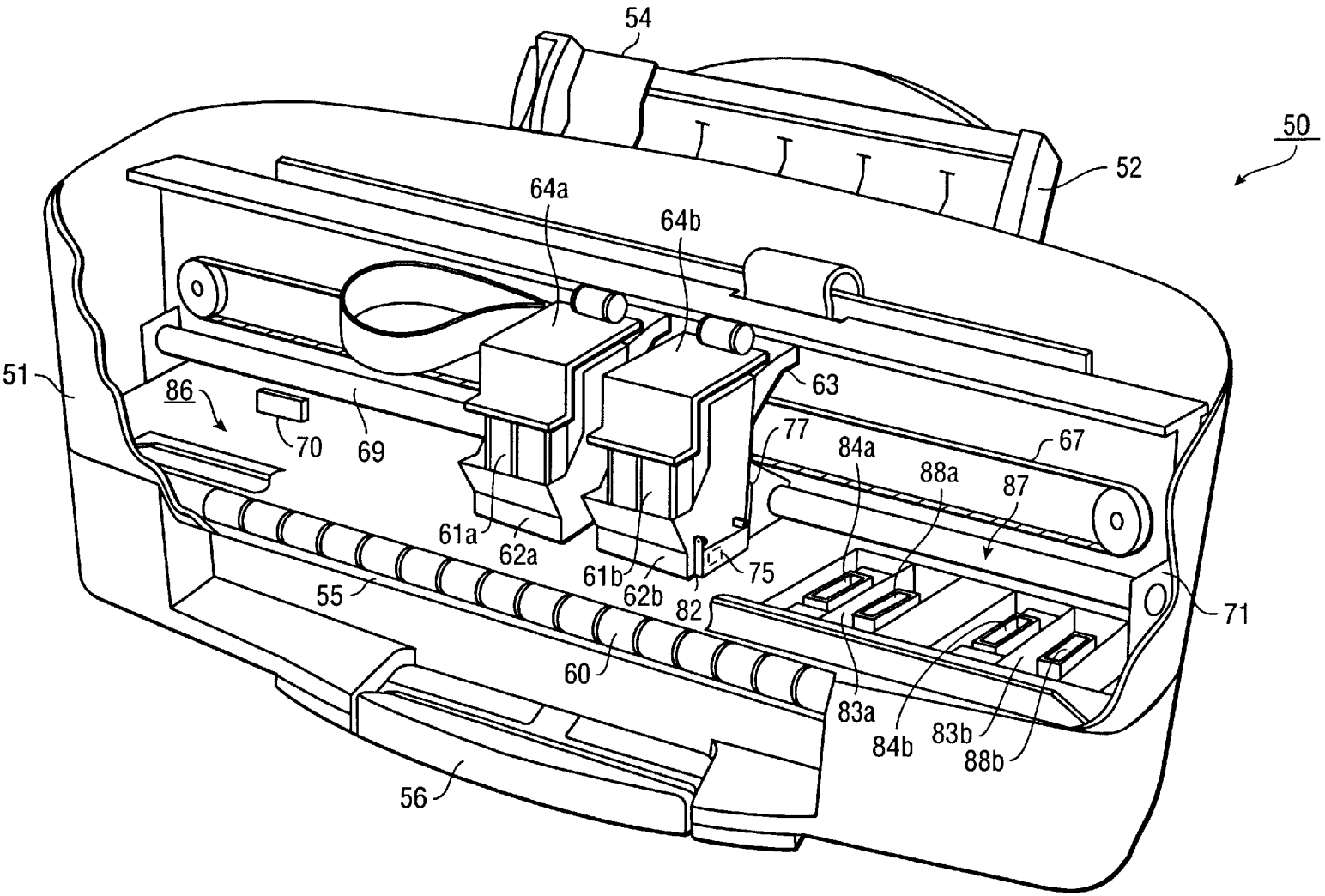
FIG. 6 is a cut-away front perspective view of the printer of FIG. 5, showing multiple print heads and an alignment sensor.

FIG. 6 is a cut-away front perspective view of printer 50. As shown in FIG. 6, printer 50 includes housing 51 covered by an unshown removable cover, supply tray 52 for an automatic sheet feeder, feed width adjuster 54, ejection port 55, and slidably stowable ejection tray 56. An unshown manual feed slot accepts wide-format or thick recording media. Not shown in FIG. 6 are indicator lights, power buttons, resume (on/offline) buttons, power supply and cord, and a parallel port connector for connection of printer 50 to computing equipment 40, preferably via a bi-directional communication interface.

As further shown in FIG. 6, printer 50 includes rollers 60 for feeding media from either the automatic feeder or the manual feeder through printer 50 to media ejection port 55. Removable dual print heads 61*a* and 61*b* are mounted in respective receiving stations 62*a* and 62*b* which in turn are mounted at a fixed horizontal offset on carriage 63. Covers 64*a* and 64*b* latch print heads 61*a* and 61*b* in position at receiving stations 62*a* and 62*b*. Carriage 63 is mounted for reciprocal left and right scanning movements on carriage guide rod 69, and carriage 63 is reciprocally driven across guide rod 69 by belt 67 and an unshown carriage drive motor. Carriage 63 can be driven from an extreme leftward position indicated generally at 86, which is outside of a carriage reciprocation area during normal (standard or wide width) print operations, to an extreme rightward position indicated generally at 87, which is also outside of carriage reciprocation operation area during normal printing. Position 87 is also referred to as a "home" position, and includes a pair of ink ejection stations 84*a* and 84*b*, a pair of wiping blades 83*a* and 83*b* for wiping the face of the print heads to remove ink residue, and a pair of ink capping stations 88*a* and 88*b*, each for respective ones of print heads 61*a* and 61*b*.

Hingedly mounted on carriage 63 is alignment sensor cover 75 which covers alignment sensor 82 (shown in phantom lines) during normal print operation. In FIG. 6, cover 75 is shown in the closed position so as to protect alignment sensor 82 during normal printing operations. During alignment sensor operations, cover 75 is hinged to an open position. To hinge the cover to the open position, upstanding tab 70 is provided at area 86. When carriage 63 is moved to extreme area 86, tab 70 engages with a lower surface of cover 75 so as to hinge the cover outwardly to the open position. Thereafter, to hinge the cover inwardly to a closed position, carriage 63 is moved to area 87 where a corner 71 of the printer chassis hinges the cover back to the closed position.

Figure 7:
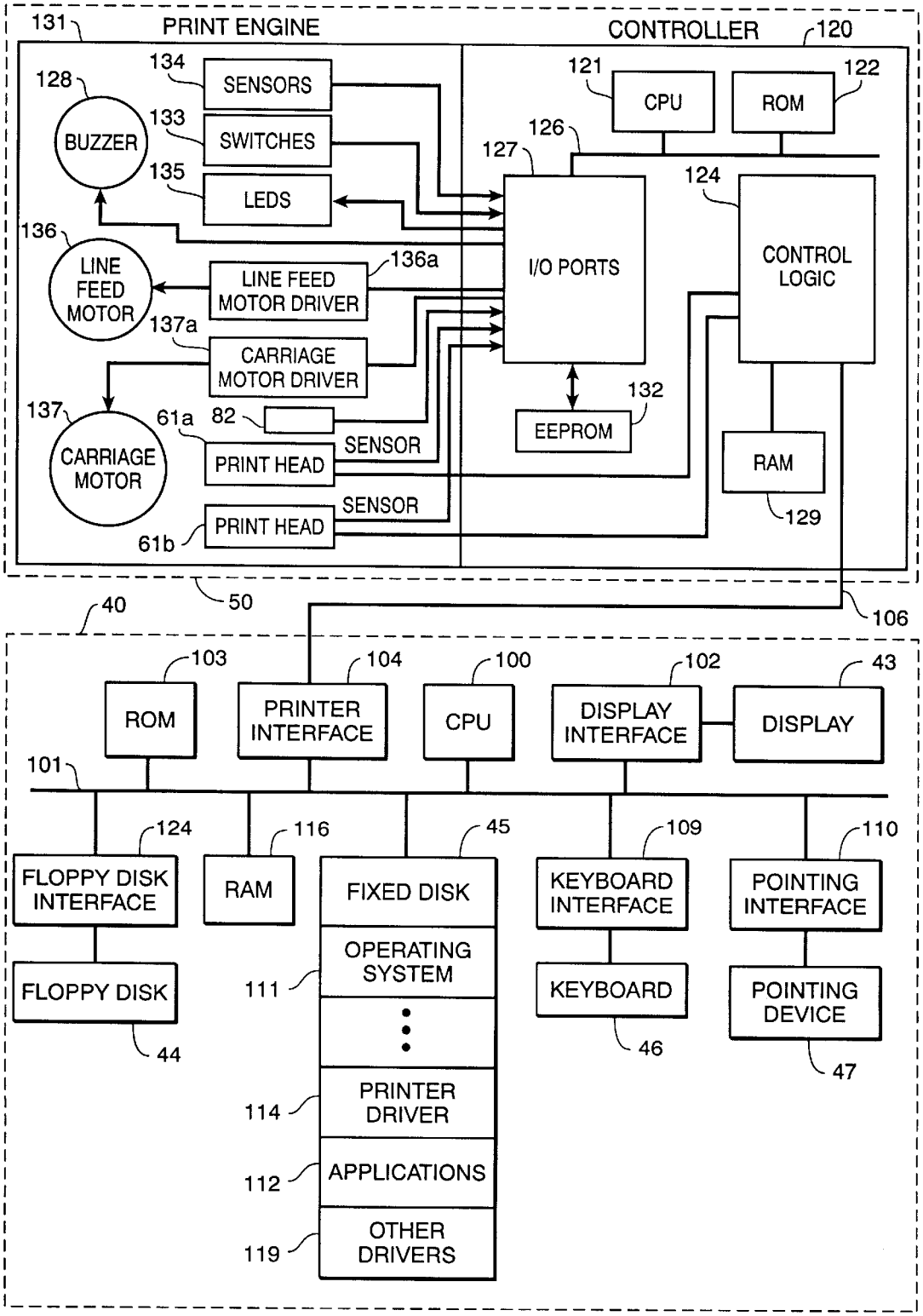
FIG. 7 is a detailed block diagram showing the hardware configuration of computing equipment interfaced to the printer of FIG. 5.

FIG. 7 is a block diagram showing the internal structures of computing equipment 40 and printer 50. In FIG. 7, computing equipment 40 includes a central processing unit ("CPU") 100 such as a programmable microprocessor interfaced to computer bus 101. Also coupled to computer bus 101 are display interface 102 for interfacing to display 43, printer interface 104 for interfacing to printer 50 through a bidirectional communication line 106, floppy disk interface 124 for interfacing to floppy disk drive 44, keyboard interface 109 for interfacing to keyboard 46, and pointing device interface 110 for interfacing to pointing device 47. A random access memory ("RAM") 116 interfaces to computer bus 101 to provide CPU 100 with access to memory storage. In particular, when executing stored program instruction sequences, CPU 100 loads those instruction sequences from disk 45 (or other memory media such as computer readable media accessed via an unshown network interface) into RAM 116 and executes those stored program instruction sequences out of RAM 116. It should also be recognized that standard disk-swapping techniques available under windowing operating systems allow segments of memory to be swapped on and off disk 45 to RAM 116.

Read only memory ("ROM") 103 in computing equipment 40 stores invariant instruction sequences, such as start-up instruction sequences or basic input/output operating system ("BOIS") sequences for operation of keyboard 46.

Disk 45 is one example of a computer readable medium that stores program instruction sequences executable by CPU 100 so as to constitute operating system 111, application programs 112, printer driver 114 and other application programs, files, and device drivers such as driver 119. Application programs are programs by which computing equipment 40 generates files, manipulates and stores those files on disk 45, presents data on those files to a user via display screen 42, and prints data via printer 50. Disk 45 also stores an operating system 111 which, as noted above, is preferably a windowing operating system. Device drivers are also stored on disk 45. At least one of the device drivers comprises a printer driver 114 which provides a software interface to printer 50. Data exchanged between computing equipment 40 and printer 50 is effected by the printer driver, as described in more detail below. In particular, alignment according to the invention is controlled by program instruction sequences coded by printer driver 114.

Referring again to FIG. 7, printer 50 includes print controller 120 and print engine 131. Print controller 120 contains computerized and electronic devices used to control print engine 131, and print engine 131 includes physical devices such as carriage and line feed motors together with a print carriage and print heads depicted in FIG. 6 for obtaining print output. As shown in FIG. 7, print controller 120 includes CPU 121 such as an 8-bit or 16-bit microprocessor, ROM 122, control logic 124 and I/O ports 127 connected to bus 126. Also connected to control logic 124 is RAM 129. Connected to I/O ports 127 is EEPROM 132 for storing printer parameters such as alignment parameters.

Print engine 131 includes line feed motor 136 controlled by line feed motor driver 136*a* , and carriage motor 137 controlled by carriage motor driver 137*a*. Dual print heads 61*a* and 61*b* are removable print heads carried on carriage 63 (FIG. 6) and include ink ejection nozzles for forming a printed image on a recording medium, as well as sensors to provide feedback as to the presence and characteristics of the removable print heads. Alignment sensor 82, together with an unshown analog-to-digital converter for conversion of analog signals into digital signals, is also connected to I/O ports 127. Also provided in print engine 131 are audible buzzer 128, cover sensors 134, useractuatable switches 133 and indication LEDs 135.

Control logic 124 provides control signals for nozzles in print heads 61*a* and 61*b* and further provides control logic for line feed motor driver 136*a* and carriage motor driver 137*a*, via I/O port 127. I/O port 127 receives sensor output from print heads 61*a* and 61*b*, sensor output from sensors 134 and switches 133, and in addition provides control signals for buzzer 128 and LEDs 135. As noted above, I/O ports 127 channel control signals from control logic 124 to line feed motor driver 136*a* and carriage motor driver 137*a*.

ROM 122 stores font data, program instruction sequences to control printer 50, and other invariant data for printer operation. RAM 129 stores print data in a print buffer defined by the program instruction sequences in ROM 122, for printout by print heads 61*a* and 61*b*. EEPROM 132 provides non-volatile reprogrammable memory for printer information such as print head configuration and print head alignment parameters. EEPROM 132 also stores parameters that identify the printer, the printer driver, the print heads, alignment of the print heads, status of ink in the ink cartridges, all of which may be provided to print driver 114 in computing equipment 40 so as to inform computing equipment 40 of operational parameters of printer 50, and so as to allow print driver 114 to change print data sent to printer 50 over bi-directional communication line 106 so as to accommodate various configurations of printer 50.

Figure 8:
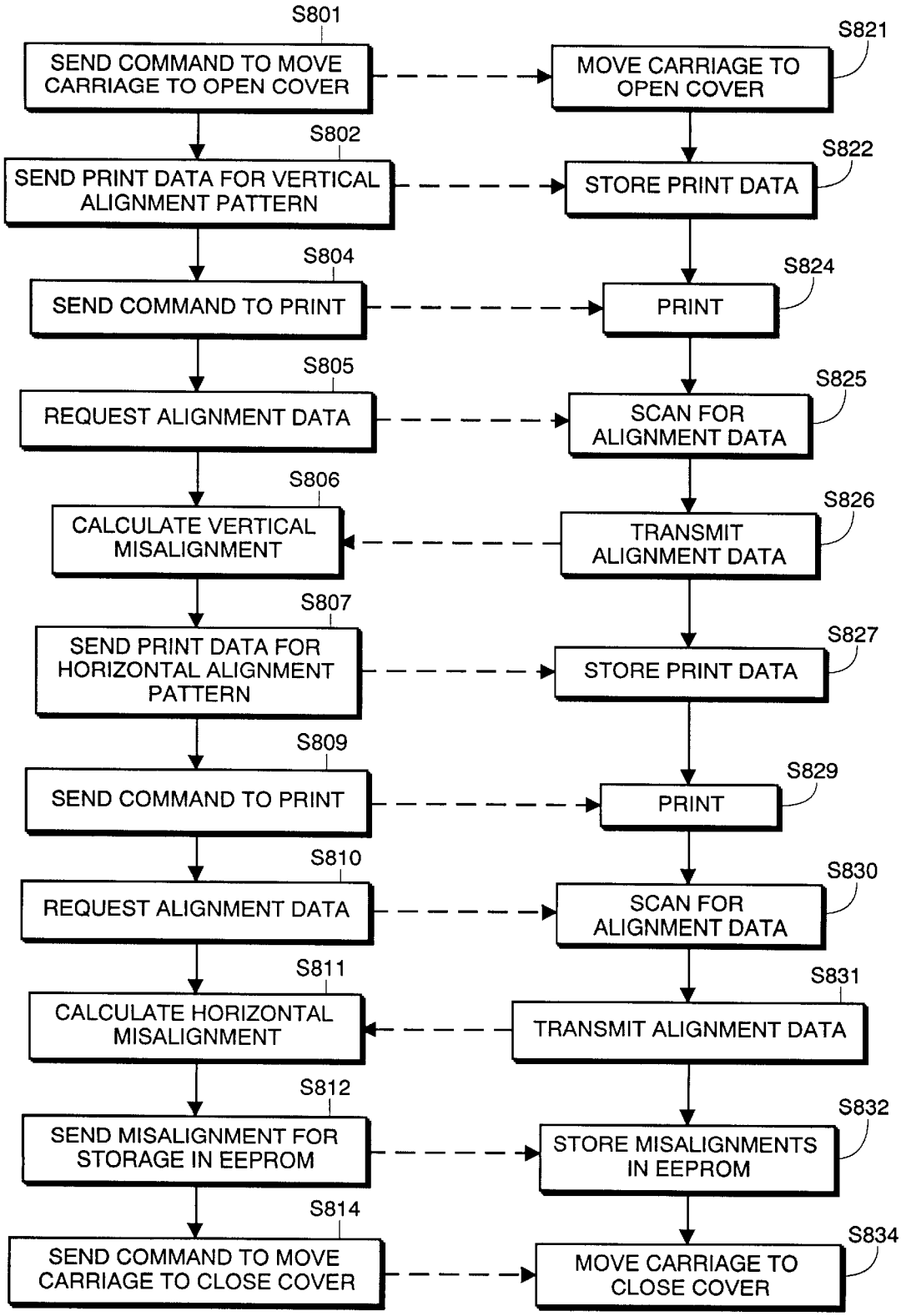
FIG. 8 is a view for explaining printout of alignment patterns according to the invention.

FIG. 8 is a flow diagram illustrating computer-executable stored program instruction sequences constituting automatic alignment according to one embodiment of the invention. The process steps shown in the left-hand side of FIG. 8 are preferably stored in printer driver 114 on disk 45 and are executed by CPU 100 so as to send print data for alignment patterns to printer 50, and so as to calculate print head misalignment data for storage in printer 50. On the other hand, the process steps shown in the right-hand side of FIG. 8 are preferably stored in ROM 122 for execution by CPU 121 so as to receive print data for alignment patterns, print the alignment patterns, and scan using alignment sensor 82 for density of the alignment patterns. In FIG. 8, solid lines refer to flow sequences within each of CPUs 100 and 121, whereas dashed lines refer to communications over bi-directional communication link 106.

Generally speaking, the stored program instruction sequences illustrated in FIG. 8 comprise automatic alignment of two of at least multiple print heads by printing alignment patterns by each of the print heads, with the alignment patterns being repetitive patterns in which not all pixels of the pattern are printed, and with one of the patterns having a gradual variation in phase with respect to the other. The alignment patterns are superimposingly printed, and density thereof is sensed by a sensor for calculation of misalignment between the two print heads. Thereafter, the misalignment may be stored for use in subsequent print operations, such as by modifying print data so as to compensate for misalignment between the heads.

In more detail, in step S801, computing equipment 40 sends a command to printer 50 to move carriage 63 to the extreme leftward position so as to open cover 75. After the carriage has moved so as to open cover 75 (step S821), flow advances to step S802 in which computing equipment 40 sends print data for a vertical or a horizontal alignment pattern. Preferably, vertical alignment is performed first so as to ensure that when horizontal alignment is conducted, printed pixels for one print head dovetail into interstices between printed pixels in the other print head, as described more fully below.

According to one feature of the invention, the alignment patterns transmitted in step S802 (and in step S807, described below) are patterns in which not all pixels are printed for each pattern for each head. Preferably, when aligning two heads to each other, a 50% alignment pattern is transmitted, meaning that only 50% of the pixels in each alignment pattern are printed by each head. More preferably, the alignment patterns are in a checkerboard arrangement, such that printed pixels for the alignment pattern for one head dovetail into the interstices between printed pixels in the alignment pattern for the other head.

Figure 9:
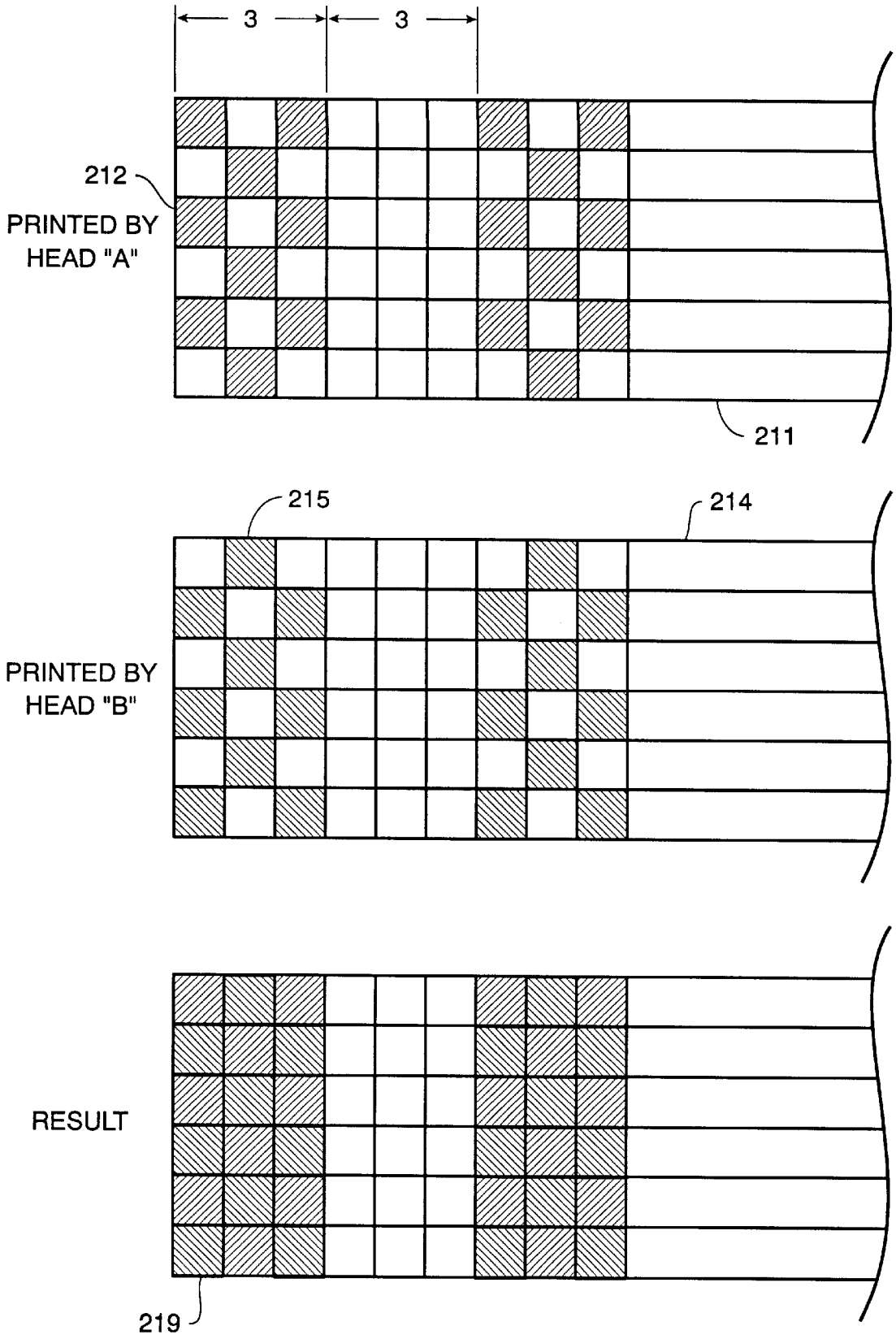
FIG. 9 is a view showing one preferred arrangement of alignment patterns according to the invention.

FIG. 9 shows one preferred arrangement of alignment patterns according to the invention, used to align the print heads in the horizontal direction. As shown in FIG. 9, alignment pattern 211 for printout by print head A includes vertical columns 212 of 50% printed pixels three columns wide, followed by three columns of no printout. The pattern is repeated across the entire print width. As shown at 211, the printed pattern is a 50% gray with every other pixel filled in, in a checkerboard pattern. In this regard, although only a few pixels in the vertical direction are shown, it is preferred for the vertical columns to extend for at least 50, and preferably 100 or more pixels vertically, in correspondence to the width of the sensing face of sensor 82.

The alignment pattern 214 for printout for print head B also includes vertically arranged columns three pixels wide followed by three columns of blank pixels, repeated cyclically across the recording medium. Again, although only a few pixels in the vertical direction are shown, the pattern should extend at least 50, and preferably 100 or more pixels vertically. Although the pattern is repeated cyclically across the page, the phase (or starting position) of the pattern is gradually shifted horizontally at a low cycle across the recording medium, so as preferably to complete one or more cycles of the pattern across the page.

As depicted at 215 in FIG. 9, the pattern for printout by print head B is substantially the same as that for print head A in that the pattern is comprised by a 50% gray pattern arranged in a checkerboard such that every other pixel is printed. More preferably, however, the pattern is offset by one pixel vertically, such that printed pixels for the pattern of print head B dovetail into interstices between printed pixel for the pattern of print head A. This result is depicted at 219 which shows the result of superimposition of the printed alignment patterns.

In order to ensure that proper dovetailing occurs between the two alignment patterns, it is preferred for alignment to proceed first in the vertical direction and thence in the horizontal direction. Thus, reverting again to FIG. 8, step S802 sends print data for vertical alignment patterns. After printer 50 has received the print data (step S822) computing equipment 50 sends a command to print the alignment patterns (step S804) resulting in execution by printer 50 of the alignment patterns (step S824).

After printer 50 prints the alignment patterns, flow in computing equipment 40 advances to step S805 in which a request is sent to printer 50 for alignment data. Printer 50 responds in step S825 by scanning across the recording medium with alignment sensor 82 so as to obtain, and convert from analog to digital format, alignment data for the superimposed alignment patterns. If desired CPU 100 can convert the raw digital output of sensor 82 into printed density readings. In step S826, printer 50 transmits the alignment data to computing equipment 40.

In step S806, computing equipment 40 calculates a vertical misalignment based on the alignment data. In particular, computing equipment 40 operates to obtain the darkest lightest density region of alignment patterns, corresponding to perfect alignment between print heads A and B. Vertical alignment data is stored and used to modify subsequent print data so as to compensate for vertical misalignment.

Flow then advances to step S807 in which computer 40 sends print data for horizontal alignment patterns. Printer 50 receives the print data (step S827), and following receipt of a command to print (step S809) from computing equipment 40, flow advances to step S829 in which the printer prints the horizontal alignment pattern.

Flow in computing equipment 40 then advances to step S810 in which a request is transmitted to printer 50 for alignment data. Printer 50 responds by scanning for alignment data (step S830) and transmitting the alignment data after conversion from analog to digital format (and possibly to density readings) back to computing equipment 40 (step S831). Computing equipment 40 then calculates horizontal misalignment between the two print heads (step S811). As mentioned previously, calculation of horizontal misalignment consists of detection of the lightest printed density pattern from the alignment sensor data, in correspondence to a phase shift of the alignment pattern for print head B at which vertical columns of alignment pattern data for print head B completely overlap onto vertical columns for alignment pattern printout for print head A.

Flow in computing equipment 40 then advances to step S812 in which computing equipment 40 sends misalignment data for each of the print heads to printer 50 for storage in EEPROM 132 (step S832). Computing equipment 40 then sends a command (step S814) to move carriage 163 to the extreme right hand home position so as to close sensor cover 75. Following movement of carriage 63 to the close cover position (step S834), automatic alignment is complete.

Figure 4:
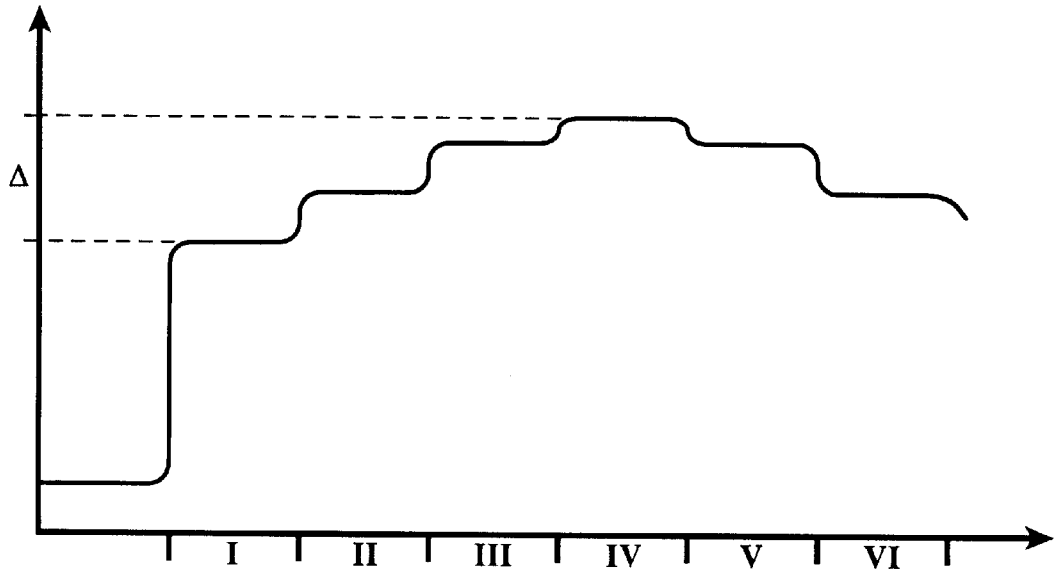
FIG. 4 is a graph showing output of density detection for an automatic alignment sensor.

FIG. 10 is a view for explaining how to calculate misalignment, either in the vertical or horizontal direction in accordance with steps S806 or S811, based on density data obtained from alignment sensor 82. Specifically, as explained above in connection with FIG. 4, it is often difficult to determine which density reading is the lightest, or the darkest, especially when the density readings from alignment sensor 82 have sensor noise and other irregularities superimposed on them. In accordance with this aspect of the invention, rather than comparing absolute values of the density readings, what is compared is density differences between pairs of density readings. Specifically, in a case where the phase of one alignment pattern is gradually shifted cyclically with respect to the other alignment pattern, lightest and darkest density patterns will occur in pairs. The pairs will always be one half of the total number of cyclic steps. For example, in a case where there are n cyclic steps of phase shift for one pattern with respect to the other, then there will be n/2 pairs of lightest and darkest patterns. If n=6 (meaning there are six cyclic steps in phase for one pattern with respect to the other), then if the first pattern is lightest, then the fourth pattern will be the darkest. Likewise, if the second pattern is lightest, then the fifth pattern will be darkest, and if the third pattern is lightest then the sixth pattern will be darkest. Accordingly, the differences between the first and fourth, second and fifth, and third and sixth patterns are obtained. The largest difference is the difference that has the pair of lightest and darkest values. The lightest of that pair is then considered to be the region corresponding to perfect alignment between the two sensors.

Thus, FIG. 10 shows density readings stored in computing equipment 40 in response to requests (in steps S805 or S810) for alignment data from alignment sensor 82. As shown in FIG. 10, for each region, multiple density readings are obtained, such as 10 or 12 readings per region each corresponding to readings from alignment sensor 82 during the course of sensing of the alignment pattern densities. Generally speaking, for each region the density readings will not be constant but rather will have sensor noise and other irregularities superimposed thereon. Thus, for example, for region I, j density readings are obtained such as density readings $D_{11}$, $D_{12}$, . . . $D_{Ij}$. To reduce the effects of such noise, the readings may be averaged so as to obtain an average reading for region I. In addition, it may be preferable to discard readings at the edge of each region, so as to avoid the possibility that such readings have been affected by densities from adjacent regions.

Thus, for each of the N regions for which a cyclic step in phase is taken for one alignment pattern with respect to the other, average density readings are obtained. In the situation depicted in the present invention, where N=6, averages $\overline{D}_I$ through $\overline{D}_{VI}$ are obtained.

Differences are thereafter formed between pairs of the average readings. In the present example, where N=6, differences are formed between the first and fourth region, the second and fifth region, and the third and sixth regions. These differences are depicted as $\Delta_A$, $\Delta_B$ and $\Delta_c$.

To determine which region corresponds to perfect alignment between the heads, the largest difference is obtained. Then, the region whose density is lightest from the pair of densities corresponding to the largest difference is determined to be the region where alignment between the heads is perfect.

Figure 11A:
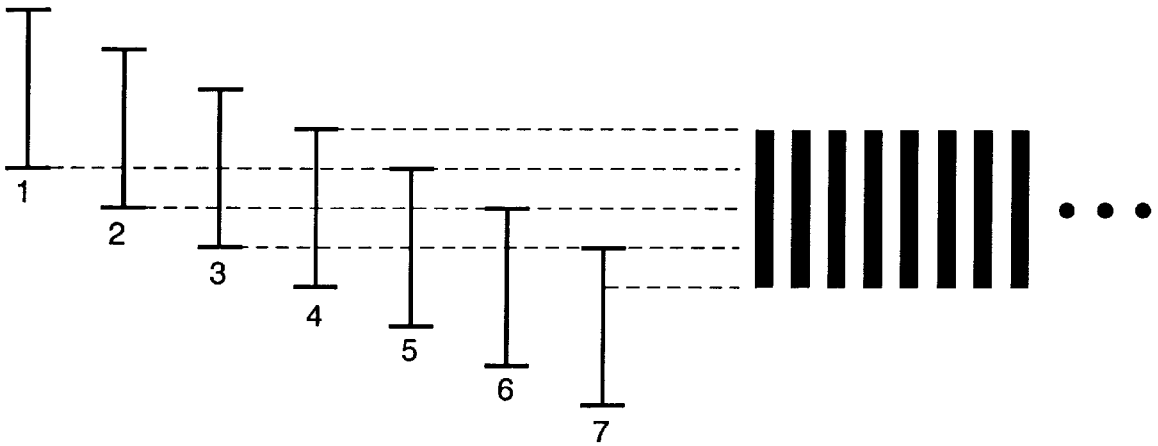
FIGS. 11A and 11B are views for explaining printout of alignment patterns in multiple passes.
Figure 11B:
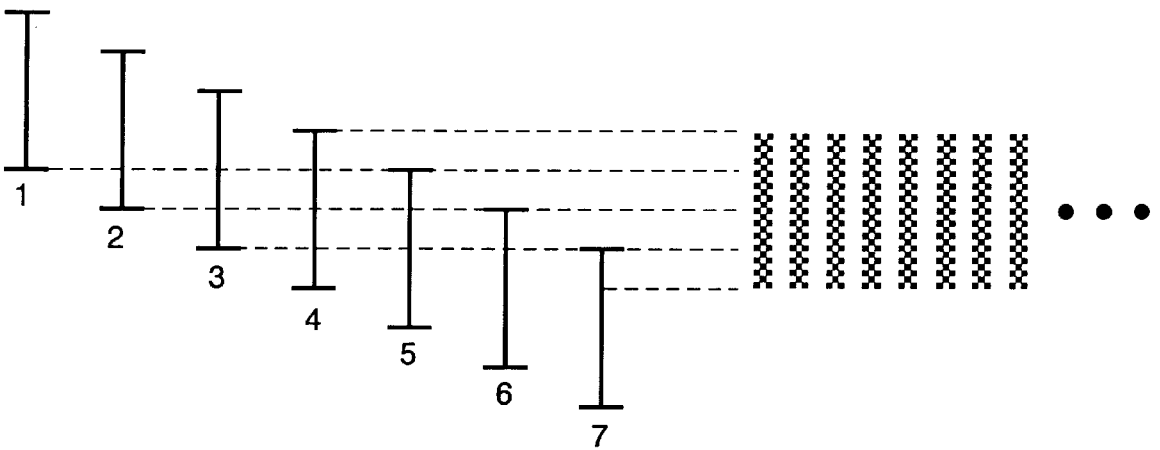

FIGS. 11A and 11B are views for explaining printout of alignment patterns in multiple passes, in accordance with another embodiment of the invention, so as to reduce the effects of irregularities caused by printing anomalies such as non-constant or non-repeatable carriage speed, nozzle misfirings, oblique discharge or nozzle cloggings. FIGS. 11A and 11B depict multi-pass printing of alignment patterns for measuring horizontal misalignment, but the invention may be applied to printout of alignment patterns for measuring vertical misalignments.

As depicted in these figures, the alignment pattern is printed in multiple passes, such as seven passes, with a paper advance between each pass. In each pass, print data for the alignment pattern is masked with a different one of mutually exclusive masking patterns so as to ensure that the same pixel for an alignment pattern is not printed more than once. As shown, for example in FIG. 11A, ¼ of the pixels in the top ¼ of the alignment pattern are printed in the first pass, ¼ of the pixels in the top ½ of the alignment pattern are printed in the second pass, ¼ of the pixels in the top ¾ of the alignment pattern are printed in the third pass, and so on. By virtue of the foregoing, four passes are required to print each quarter of the vertical extent of the alignment pattern, for a total of seven passes all together.

Since seven passes are needed to print the alignment pattern, the effects of printing anomalies such as non-consistent or non-repeatable carriage speed, nozzle misfiring, oblique discharge or nozzle clogging is distributed throughout the alignment pattern, removing localized effects on the resulting alignment pattern. Accordingly, the overall alignment pattern is improved in quality.

Figure 12:
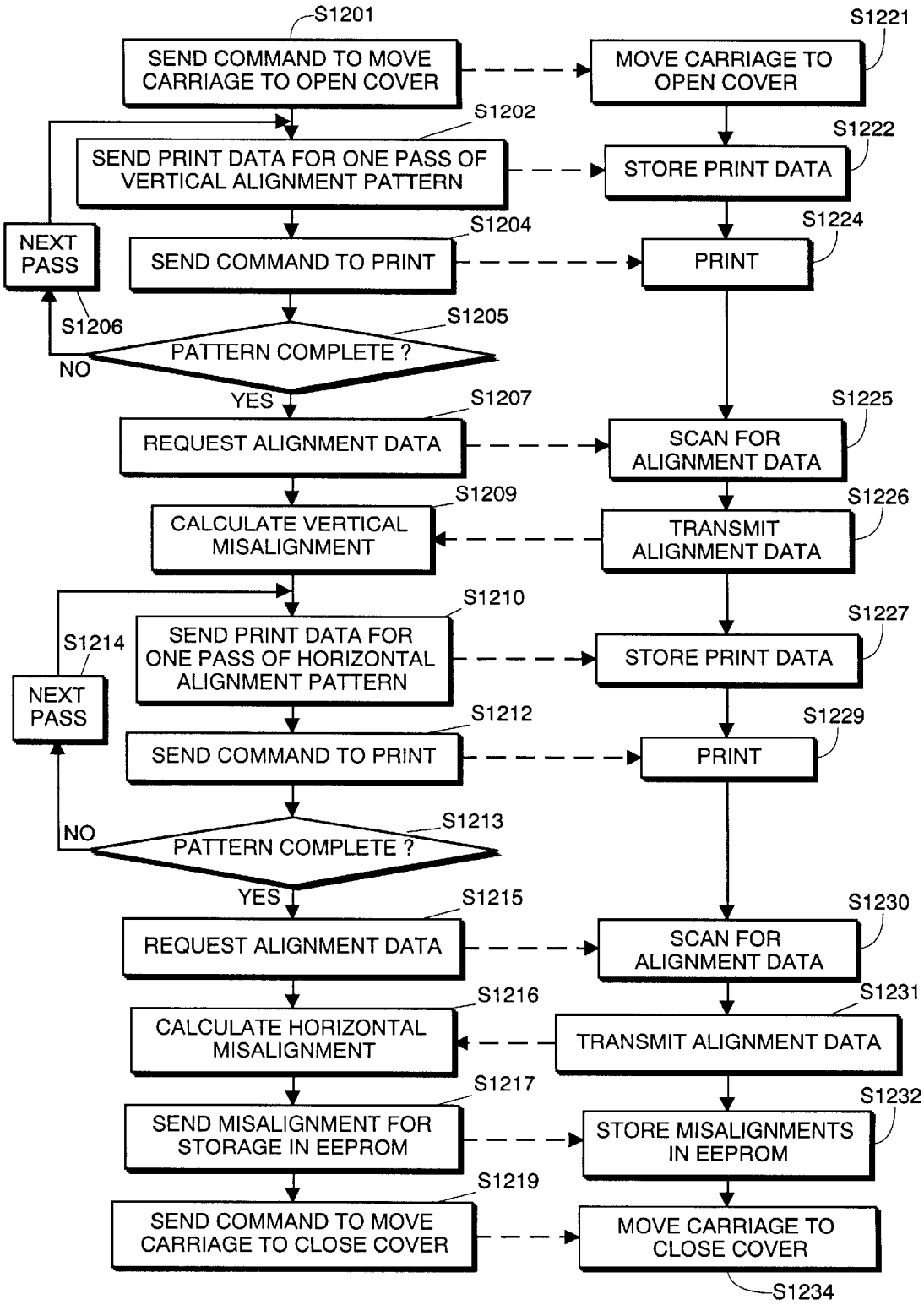
FIG. 12 is a flow diagram showing how an alignment pattern is printed in multiple passes.

FIG. 12 is a flow diagram showing how an alignment pattern is printed in multiple passes according to this embodiment of the invention. In FIG. 12, steps S1221 through S1234 are process steps performed by printer 50, and are more or less similar to process steps S821 through S834 in FIG. 8.

The left-hand process steps shown in FIG. 12 are process steps performed by computing equipment 40 so as to send print data for alignment patterns in multiple passes. Thus, step S1201 sends a command to printer 50 to cause carriage 63 to move to the left-most position so as to open cover 75. Step S1202 sends print data for one pass of a vertical alignment pattern to the printer, and step S1204 sends a command to the printer so as to printout the print data for one pass. Step S1205 determines whether the complete alignment pattern has been printed. Until the complete alignment pattern has printed, flow returns to step S1206, which obtains the next pass of print data for the alignment pattern, to step S1202 which sends the print data for subsequent passes of the vertical alignment pattern to printer 50.

Once the complete alignment pattern has been printed, in multiple passes, computing equipment 40 sends a request (step S1207) to printer 50 for alignment data. Step S1209 calculates vertical misalignment. computing equipment 40 uses the vertical misalignment to correct subsequent print data, such as the print data for the horizontal alignment pattern which is next scheduled for printout in accordance with steps S1210 through S1219.

Thus, in step S1210, print data for one pass of the horizontal alignment pattern is sent to printer 50, and step S1212 sends a command to print out the pass. Step S1213 tests whether a complete alignment pattern has been printed. Until a complete alignment patten has been printed, flow returns through step S1214, which advances to the next pass of the alignment pattern, to step S1210 for subsequent printout of each of the alignment pattern passes.

When a complete horizontal alignment pattern has been printed, flow advances to step S1215 which requests alignment data, and step S1216 which calculates the horizonal misalignment based on the returned alignment data. The horizontal and vertical misalignments are sent (step S1217) to printer 50 for storage in EEPROM, whereafter computing equipment 40 sends a command (step S1219) to move the carriage to the right-most position so as to close cover 75.

Figure 13:
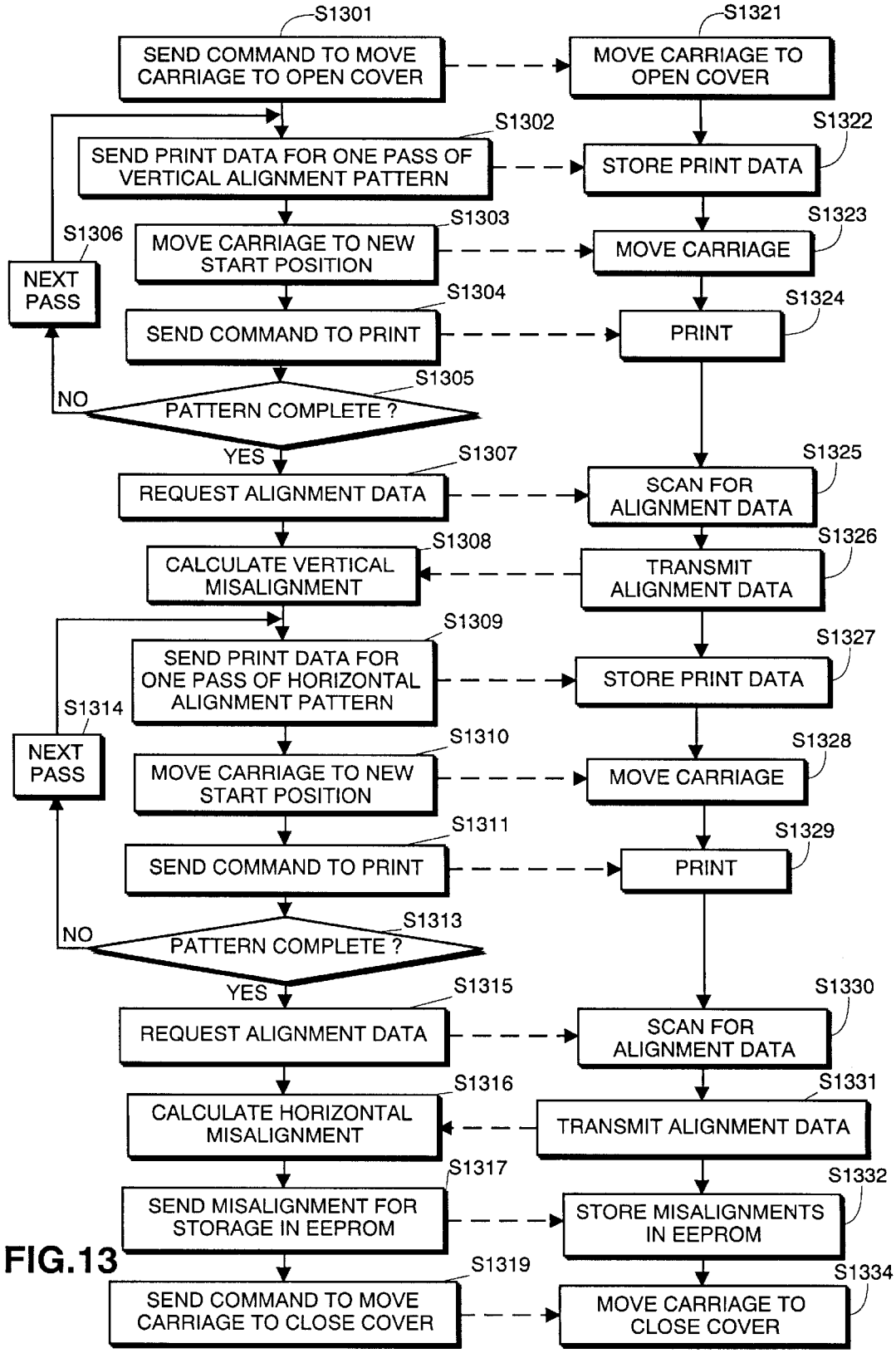
FIG. 13 is a flow diagram for explaining another embodiment of the invention, in which multi-pass printout of the alignment patterns is combined with a shift in carriage start position between each pass.

FIG. 13 is a flow diagram for explaining another embodiment of the invention, in which multi-pass printout of the alignment patterns is combined with a shift in carriage start position between each pass. As in the embodiment of FIG. 12, multi-pass printout of the alignment pattern reduces the effect of printing anomalies such as carriage speed non-uniformity or non-repeatability, nozzle misfirings, oblique ink discharge or nozzle cloggings. In addition, a shift in carriage start position between each pass minimizes the effects of non-constant carriage speed caused by speed overshoot and ringing. This is explained in connection with FIG. 14.

Figure 14:
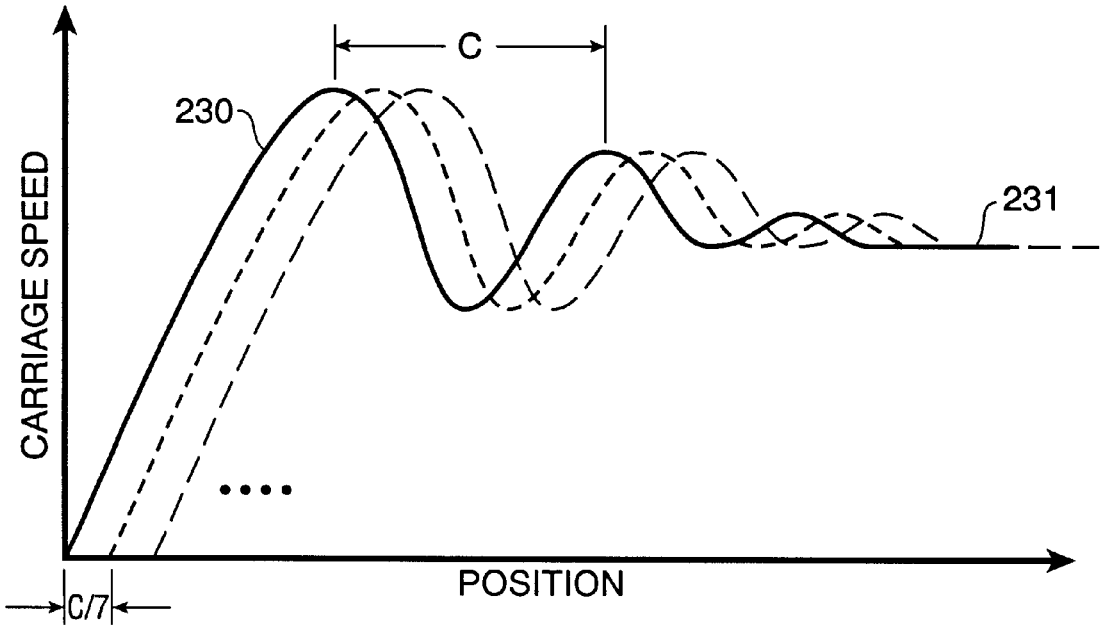
FIG. 14 is a graph of carriage speed versus carriage position across the recording medium.

Specifically, solid line 230 in FIG. 14 is a graph of carriage speed versus carriage position across the recording medium. As carriage 63 ramps up from a standing position to target scanning speed 231, the carriage speed first overshoots and then undergoes ringing. Ringing takes place with a cycle whose distance is "C", as measured across the recording medium from the first peak in carriage speed to the next peak thereof.

Figure 1:
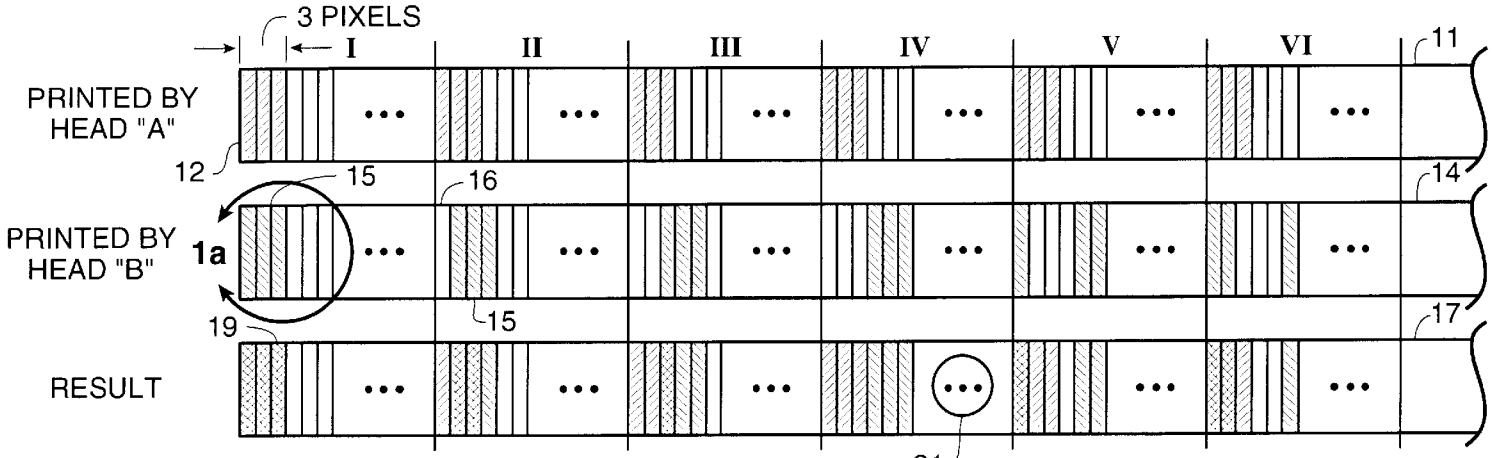
FIGS. 1 and 2 are views for explaining horizontal and vertical alignment patterns by which multiple print heads may be aligned automatically.
Figure 1A:
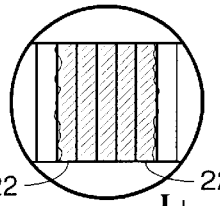
FIG. 1A is an expanded view of one region in FIG. 1.
Figure 2:
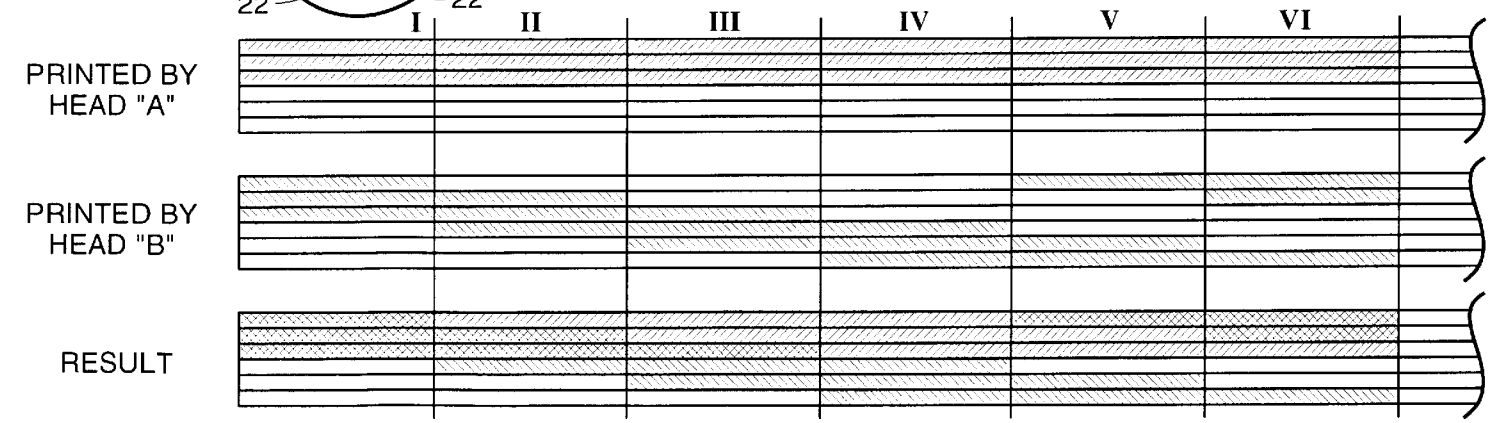
Figure 3:
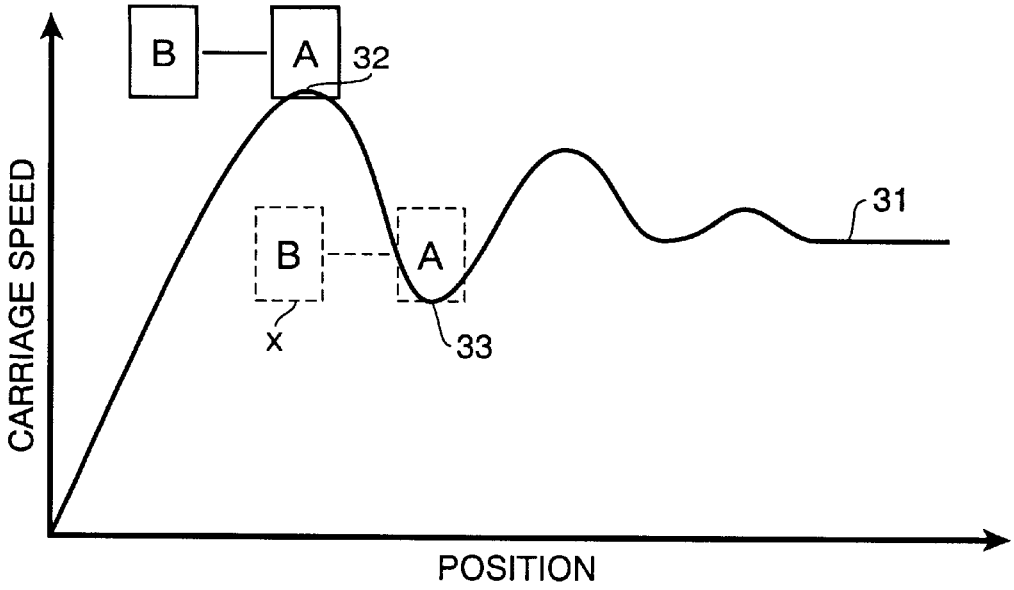
FIG. 3 is a graph for explaining variations in carriage speed.

As explained above in connection with FIG. 3, such ringing causes degradation in the quality of the alignment pattern, since when printing at one position on the recording medium print head A is travelling at a different speed than print head B.

According to this embodiment of the invention, for each subsequent pass of multi-pass printing of the alignment pattern, the carriage start position is shifted slightly relative to the starting position for a previous pass. Preferably, the starting position is shifted such that the cycle distance "C" is completely covered over the course of the multiple passes that are needed to print the alignment pattern. Thus, since the present embodiment requires seven passes to print a complete alignment pattern, each subsequent pass shifts the carriage start position by a distance of "C/7" relative to the preceding pass.

FIG. 13 illustrates the flow of this operation. In FIG. 13, steps S1321 through S1334 are more or less similar to corresponding steps S821 through S834, with the exception that steps S1323 and S1328 move carriage 63 to the scan start position commanded by computing equipment 40.

The left-hand process steps S1301 through S1319 of FIG. 13 operate to print horizontal and vertical alignment patterns in multiple passes with a shift in carriage start position between each pass. Thus, step S1301 sends a command to move carriage 63 to the left-most position so as to open cover 75 and expose alignment sensor 82. Step S1302 sends print data for one pass of the vertical alignment pattern to printer 50, and step S1303 sends a command to move carriage 63 to a new start position. Step S1304 sends a command to print the alignment pattern data. Until the alignment pattern data is complete, step S1305 causes flow to return through step S1306, which obtains the next pass of the vertical alignment pattern, back to step S1302 so as to send the next pass of vertical alignment pattern data to printer 50. Step S1303 again operates to shift the carriage start position, as depicted in FIG. 14, for the next subsequent pass of alignment data, and processing loops until a complete alignment pattern has been printed.

When a complete vertical alignment pattern has been printed, flow advances to step S1307 where computing equipment 40 requests alignment data, to step S1309 where computing equipment 40 calculates the vertical misalignment. The vertical misalignment is used in calculating subsequent print data, such as the print data needed to obtain horizontal alignment patterns according to steps S1310 through step S1319.

Step S1310 sends print data for one pass of the horizontal alignment pattern, and step S1311 moves carriage 63 to a new start position so as to print the current pass of horizontal alignment print data. Step S1312 sends a command to print the data. Until the horizontal alignment pattern has been completely printed, step S1313 causes flow to return through step S1314 which obtains a next pass of horizontal alignment pattern data to step S1310 which sends the print data for the next horizontal pass. Again, step S1311 shifts the carriage starting position as depicted in FIG. 14, and processing loops until a complete pattern has been printed.

After a complete pattern has been printed, flow advances to step S1315 which requests alignment data, to step S1316 which calculates horizontal misalignment. Computing equipment 40 thereafter sends misalignments to printer 50 for storage in EEPROM, whereafter a command is sent to move the carriage to the home position so as to close cover 75.

Although the flow of FIG. 13 has been described with respect to printout of alignment patterns, cyclic shift of the print start position can also be applied to printout of standard print jobs such as image or character data, so as to improve the printed appearance of the print job by reducing the effects of the printing anomalies mentioned above (i.e., carriage speed non-uniformities or non-repeatability, ringing and overshoot, nozzle misfirings, oblique ink discharge or nozzle cloggings). In this case, the entire page of the print job is printed with the above-described multi-pass masked printing, with a shift in carriage start position between each pass. N is selected to be a convenient number, such as 4, and the cycle of carriage shifts before each pass progresses cyclically in the distance as follows:

$$0,\ C/N,\ 2C/N,\ 3C/N\ \ldots\ (N-1)C/N,\ 0,\ \ldots$$

where C is as shown in FIG. 14.

The invention has been described with respect to particular illustrative embodiments. It is to be understood that the invention is not limited to the above-described embodiments, and that various changes and modifications may be made by those of ordinary skill in the art without departing from the spirit and scope of the invention.

For example, although the above embodiments have described a situation in which multiple print heads are aligned to each other, it is also possible to employ the principles of the invention to a situation in which printout by one print head is aligned to itself. For example, using the invention, it is possible to align forward print out for one print head with respect to reverse print out for the same print head. In such a situation, alignment in the vertical direction is not ordinarily needed, and alignment can be limited to measurements of misalignments only in the horizontal direction, such misalignments possibly being caused by carriage inaccuracies, non-perpendicular ink discharge, mechanical torsional forces, and the like.

Moreover, the principles of the invention can be applied to printers other than ink jet printers, such as dot matrix printers, thermal printers, and the like. In addition, where multiple print heads are involved, the heads need not necessarily be fixed relative to each other, but rather may be movable independently. One, two, three, four or more print heads may be involved.

In describing the invention a 50% gray checkerboard pattern was preferred, but other patterns can be used so long as not all pixels in a pattern are printed. Moreover, non-checkerboard patterns can be used to advantage, especially where the print heads are deliberately designed to have pixel printing patterns that do not lie on a rectangular grid.

Furthermore, although printout of patterns used for alignment has been described, the printed patterns can be used for other purposes such as density matching, resolution calibration, and the like.

Accordingly, the invention should not be limited to any particular illustrative embodiment, and should instead be measured by reference to the appended claims.

What is claimed is:

1. A method for determining misalignment between first and second printed alignment patterns comprising:

printing the first alignment pattern, the first alignment pattern being comprised by a repetitive pattern in which not all pixels of printed portions of the pattern are printed;

printing the second alignment pattern in superimposed relationship over the first alignment pattern, the second alignment pattern being comprised by the same repetitive pattern as the first alignment pattern in which not all pixels of printed portions of the pattern are printed but with phase thereof being shifted gradually with respect to the first alignment pattern; and measuring print density of the superimposition of the first alignment pattern over the second alignment pattern so as to determine misalignment between the first and second alignment patterns.

2. A method according to claim 1, wherein printed portions of the alignment patterns are comprised by fifty percent gray printed patterns.

3. A method according to claim 2, wherein the alignment patterns are comprised by checkerboard patterns in which every other pixel is on.

4. A method according to claim 3, wherein the alignment patterns are comprised by checkerboard patterns in which every other pixel is off.

5. A method according to claim 4, wherein the checkerboard of the first alignment pattern is offset vertically by one pixel with respect to the checkerboard pattern of the second alignment pattern.

6. A method according to claim 1, wherein the first and second alignment patterns are patterns for measuring horizontal misalignment.

7. A method according to claim 1, wherein the first and second alignment patterns are patterns for measuring vertical misalignment.

8. A method according to claim 7, further comprising the step of measuring horizontal misalignment following measurement of vertical misalignment.

9. A method according to claim 1, wherein the first alignment pattern is printed by a first print head and the second alignment pattern is printed by a second print head, and wherein the first and second print heads are mounted on a common carriage.

10. A method according to claim 1, wherein the first alignment pattern is printed by a first print head in a forward direction and the second alignment pattern is printed by the first print head in a reverse direction.

11. A method according to claim 1, wherein misalignment is determined by a host computer, and further comprising the step of transmitting the misalignment to a printing apparatus for storage therein.

12. A method for selecting a density region from among N regions of superimposingly printed alignment patterns in which the N regions vary in density cyclically from a lightest region through a darkest region and thence back to a lightest region, the selected density region corresponding to good alignment between the superimposingly printed alignment patterns, comprising the steps of:

measuring density of each region;

obtaining density difference data between density readings for pairs of regions, wherein each pair of regions is separated by N/2 regions;

determining which density difference is largest; and selecting one region from the region pair having the largest density difference, the selected one region having good alignment between the superimposingly printed alignment patterns.

13. A method according to claim 12, wherein plural density readings are obtained for each region, and further comprising the step of averaging the plural density readings for each region into a single density reading for the region.

14. A method according to claim 13, wherein density readings at borders between regions are discarded before averaging.

15. A method according to claim 13, wherein the selected one region is the lightest region.

16. A method according to claim 13, wherein the selected one region is the darkest region.

17. A method for superimposed printout of first and second alignment patterns, each alignment pattern being comprised by repetitive patterns with the phase of the second alignment pattern being shifted at a low cycle with respect to phase of the first alignment pattern, said method comprising the step of:

printing the first alignment pattern on a recording medium in multiple passes and printing the second alignment pattern on a recording medium in multiple printing passes.

18. A method according to claim 17, further comprising the step of advancing the recording medium between each pass.

19. A method according to claim 17, further comprising the step of masking each of the first and second alignment patterns with a different one of mutually exclusive masking patterns so as to ensure that the same pixel for an alignment pattern is not printed more than once.

20. A method according to claim 17, wherein the first and second alignment patterns are printed by at least one print head mounted on a print carriage, and further comprising the step of changing a starting location for the print carriage in each pass.

21. A method according to claim 20, wherein the starting location is changed in correspondence to a distance between peaks of a ringing pattern formed by carriage ramp up speed versus distance.

22. A method according to claim 21, wherein the change in position for each pass is substantially the same as the distance between ringing patterns divided by the number of passes.

23. A method of superimposed printout of first and second patterns corresponding respectively to first and second different printings by at least one print head mounted on a carriage, said method comprising the step of:

printing the first pattern on a recording medium in multiple passes and printing the second pattern on a recording medium in multiple passes.

24. A method according to claim 23, further comprising the step of advancing the recording medium between each pass.

25. A method according to claim 23, further comprising the step of masking each of the first and second patterns with a different one of mutually exclusive masking patterns so as to ensure that the same pixel for a pattern is not printed more than once.

26. A method according to claim 23, wherein the first and second patterns are printed by at least one print head mounted on a print carriage, and further comprising the step of changing a starting location for the print carriage in each pass.

27. A method according to claim 26, wherein the starting location is changed in correspondence to a distance between peaks of a ringing pattern formed by carriage ramp up speed versus distance.

28. A method according to claim 27, wherein the change in position for each pass is substantially the same as the distance between ringing patterns divided by the number of passes.

29. A method according to claim 23, wherein the patterns are patterns for matching density.

30. A method according to claim 23, wherein the patterns are patterns for calibrating resolution.

31. A method according to claim 23, wherein the patterns are patterns for alignment.

32. A method for printing an image using multiple printing passes, comprising the steps of:

printing one band of the image at a first printing pass; and printing another band of the image at a second printing pass;

wherein starting positions of the first and second printing passes are shifted relative to each other in a same printing direction.

33. A method according to claim 32, wherein the image is printed using an ink jet head which scanningly prints across a recording medium, and wherein the starting positions of the first and second printing passes are selected in correspondence to a ringing pattern of said carriage.

34. A method according to claim 33, wherein the printing direction is a moving direction of said ink jet head.

35. An apparatus for determining misalignment between first and second printed alignment patterns comprising:

a memory for storing executable process steps; and a processor to execute said process steps stored in said memory;

wherein said process steps include steps to (a) print the first alignment pattern, the first alignment pattern being comprised by a repetitive pattern in which not all pixels of printed portions of the pattern are printed, (b) print the second alignment pattern in superimposed relationship over the first alignment pattern, the second alignment pattern being comprised by the same repetitive pattern as the first alignment pattern in which not all pixels of printed portions of the pattern are printed but with phase thereof being shifted gradually with respect to the first alignment pattern, and (c) measure print density of the superimposition of the first alignment pattern over the second alignment pattern so as to determine misalignment between the first and second alignment patterns.

36. An apparatus according to claim 35, wherein printed portions of the alignment patterns are comprised by fifty percent gray printed patterns.

37. An apparatus according to claim 36, wherein the alignment patterns are comprised by checkerboard patterns in which every other pixel is on.

38. An apparatus according to claim 37, wherein the alignment patterns are comprised by checkerboard patterns in which every other pixel is off.

39. An apparatus according to claim 38, wherein the checkerboard of the first alignment pattern is offset vertically by one pixel with respect to the checkerboard pattern of the second alignment pattern.

40. An apparatus according to claim 35, wherein the first and second alignment patterns are patterns for measuring horizontal misalignment.

41. An apparatus according to claim 35, wherein the first and second alignment patterns are patterns for measuring vertical misalignment.

42. An apparatus according to claim 41, wherein said process steps further include a step to measure horizontal misalignment following measurement of vertical misalignment.

43. An apparatus according to claim 35, wherein the first alignment pattern is printed by a first print head and the second alignment pattern is printed by a second print head, and wherein the first and second print heads are mounted on a common carriage.

44. An apparatus according to claim 35, wherein the first alignment pattern is printed by a first print head in a forward direction and the second alignment pattern is printed by the first print head in a reverse direction.

45. An apparatus according to claim 35, wherein misalignment is determined by a host computer, and further comprising the step of transmitting the misalignment to a printing apparatus for storage therein.

46. An apparatus for selecting a density region from among N regions of superimposingly printed alignment patterns in which the N regions vary in density cyclically from a lightest region through a darkest region and thence back to a lightest region, the selected density region corresponding to good alignment between the superimposingly printed alignment patterns, comprising:

a memory for storing executable process steps; and a processor to execute said process steps stored in said memory;

wherein said process steps include steps to (a) measure density of each region, (b) obtain density difference data between density readings for pairs of regions, wherein each pair of regions is separated by N/2 regions, (c) determine which density difference is largest, and (d) select one region from the region pair having the largest density difference, the selected one region having good alignment between the superimposingly printed alignment patterns.

47. An apparatus according to claim 46, wherein plural density readings are obtained for each region, and further comprising the step of averaging the plural density readings for each region into a single density reading for the region.

48. An apparatus according to claim 47, wherein density readings at borders between regions are discarded before averaging.

49. An apparatus according to claim 47, wherein the selected one region is the lightest region.

50. An apparatus according to claim 47, wherein the selected one region is the darkest region.

51. An apparatus for superimposed printout of first and second alignment patterns, each alignment pattern being comprised by repetitive patterns with the phase of the second alignment pattern being shifted at a low cycle with respect to phase of the first alignment pattern, comprising:

a memory for storing executable process steps; and a processor to execute said process steps stored in said memory;

wherein said process steps include steps to print the first alignment pattern on a recording medium in multiple passes and print the second alignment pattern on a recording medium in multiple printing passes.

52. An apparatus according to claim 51, further comprising the step of advancing the recording medium between each pass.

53. An apparatus according to claim 51, further comprising the step of masking each of the first and second alignment patterns with a different one of mutually exclusive masking patterns so as to ensure that the same pixel for an alignment pattern is not printed more than once.

54. An apparatus according to claim 51, wherein the first and second alignment patterns are printed by at least one print head mounted on a print carriage, and further comprising the step of changing a starting location for the print carriage in each pass.

55. An apparatus according to claim 54, wherein the starting location is changed in correspondence to a distance between peaks of a ringing pattern formed by carriage ramp up speed versus distance.

56. An apparatus according to claim 55, wherein the change in position for each pass is substantially the same as the distance between ringing patterns divided by the number of passes.

57. An apparatus for superimposed printout of first and second corresponding respectively to first and second different printings by at least one print head mounted on a carriage, comprising:

a memory for storing executable process steps; and a processor to execute said process steps stored in said memory;

wherein said process steps include steps to print the first pattern on a recording medium in multiple passes and print the second pattern on a recording medium in multiple passes.

58. An apparatus according to claim 57, further comprising the step of advancing the recording medium between each pass.

59. An apparatus according to claim 57, further comprising the step of masking each of the first and second patterns with a different one of mutually exclusive masking patterns so as to ensure that the same pixel for a pattern is not printed more than once.

60. An apparatus according to claim 57, wherein the first and second patterns are printed by at least one print head mounted on a print carriage, and further comprising the step of changing a starting location for the print carriage in each pass.

61. An apparatus according to claim 60, wherein the starting location is changed in correspondence to a distance between peaks of a ringing pattern formed by carriage ramp up speed versus distance.

62. An apparatus according to claim 61, wherein the change in position for each pass is substantially the same as the distance between ringing patterns divided by the number of passes.

63. An apparatus according to claim 57, wherein the patterns are patterns for matching density.

64. An apparatus according to claim 57, wherein the patterns are patterns for calibrating resolution.

65. An apparatus according to claim 57, wherein the patterns are patterns for alignment.

66. An apparatus for printing an image using multiple printing passes, comprising:

a memory for storing executable process steps; and a processor to execute said process steps stored in said memory;

wherein said process steps include steps to print one band of the image at a first printing pass, and to print another band of the image at a second printing pass and wherein starting positions of the first and second printing passes are shifted relative to each other in a same printing direction.

67. An apparatus according to claim 66, wherein the image is printed using an ink jet head which scanningly prints across a recording medium, and wherein the starting positions of the first and second printing passes are selected in correspondence to a ringing pattern of said carriage.

68. An apparatus according to claim 67, wherein the printing direction is a moving direction of said ink jet head.

69. Computer-executable process steps stored on a computer readable medium, said process steps for determining misalignment between first and second printed alignment patterns, said process steps comprising:

a printing step to print the first alignment pattern, the first alignment pattern being comprised by a repetitive pattern in which not all pixels of printed portions of the pattern are printed;

a printing step to print the second alignment pattern in superimposed relationship over the first alignment pattern, the second alignment pattern being comprised by the same repetitive pattern as the first alignment pattern in which not all pixels of printed portions of the pattern are printed but with phase thereof being shifted gradually with respect to the first alignment pattern; and a measuring step to print density of the superimposition of the first alignment pattern over the second alignment pattern so as to determine misalignment between the first and second alignment patterns.

70. Computer-executable process steps according to claim 69, wherein printed portions of the alignment patterns are comprised by fifty percent gray printed patterns.

71. Computer-executable process steps according to claim 70, wherein the alignment patterns are comprised by checkerboard patterns in which every other pixel is on.

72. Computer-executable process steps according to claim 71, wherein the alignment patterns are comprised by checkerboard patterns in which every other pixel is off.

73. Computer-executable process steps according to claim 72, wherein the checkerboard of the first alignment pattern is offset vertically by one pixel with respect to the checkerboard pattern of the second alignment pattern.

74. Computer-executable process steps according to claim 69, wherein the first and second alignment patterns are patterns for measuring horizontal misalignment.

75. Computer-executable process steps according to claim 69, wherein the first and second alignment patterns are patterns for measuring vertical misalignment.

76. Computer-executable process steps according to claim 75, further comprising a measuring step to measure horizontal misalignment following measurement of vertical misalignment.

77. Computer-executable process steps according to claim 69, wherein the first alignment pattern is printed by a first print head and the second alignment pattern is printed by a second print head, and wherein the first and second print heads are mounted on a common carriage.

78. Computer-executable process steps according to claim 69, wherein the first alignment pattern is printed by a first print head in a forward direction and the second alignment pattern is printed by the first print head in a reverse direction.

79. Computer-executable process steps according to claim 69, wherein misalignment is determined by a host computer, and further comprising the step of transmitting the misalignment to a printing apparatus for storage therein.

80. Computer-executable process steps stored on a computer readable medium, said process steps for selecting a density region from among N regions of superimposingly printed alignment patterns in which the N regions vary in density cyclically from a lightest region through a darkest region and thence back to a lightest region, the selected density region corresponding to good alignment between the superimposingly printed alignment patterns, said process steps comprising:

a measuring step to measure density of each region;

an obtaining step to obtain density difference data between density readings for pairs of regions, wherein each pair of regions is separated by N/2 regions;

a determining step to determine which density difference is largest; and a selecting step to select one region from the region pair having the largest density difference, the selected one region having good alignment between the superimposingly printed alignment patterns.

81. Computer-executable process steps according to claim 80, wherein plural density readings are obtained for each region, and further comprising the step of averaging the plural density readings for each region into a single density reading for the region.

82. Computer-executable process steps according to claim 81, wherein density readings at borders between regions are discarded before averaging.

83. Computer-executable process steps according to claim 81, wherein the selected one region is the lightest region.

84. Computer-executable process steps according to claim 81, wherein the selected one region is the darkest region.

85. Computer-executable process steps stored on a computer readable medium, said process steps for superimposed printout of first and second alignment patterns, each alignment pattern being comprised by repetitive patterns with the phase of the second alignment pattern being shifted at a low cycle with respect to phase of the first alignment pattern, said process steps comprising:

a printing step to print the first alignment pattern on a recording medium in multiple passes and to print the second alignment pattern on a recording medium in multiple printing passes.

86. Computer-executable process steps according to claim 85, further comprising advancing step to advance the recording medium between each pass.

87. Computer-executable process steps according to claim 85, further comprising a masking step to mask each of the first and second alignment patterns with a different one of mutually exclusive masking patterns so as to ensure that the same pixel for an alignment pattern is not printed more than once.

88. Computer-executable process steps according to claim 85, wherein the first and second alignment patterns are printed by at least one print head mounted on a print carriage, and further comprising the step of changing a starting location for the print carriage in each pass.

89. Computer-executable process steps according to claim 88, wherein the starting location is changed in correspondence to a distance between peaks of a ringing pattern formed by carriage ramp up speed versus distance.

90. Computer-executable process steps according to claim 89, wherein the change in position for each pass is substantially the same as the distance between ringing patterns divided by the number of passes.

91. Computer-executable process steps stored on a computer readable medium, said process steps for superimposed printout of first and second patterns corresponding respectively to first and second different printings by at least on print head mounted on a carriage, said process steps comprising:

a printing step to print the first pattern on a recording medium in multiple passes and to print the second pattern on a recording medium in multiple passes.

92. Computer-executable process steps according to claim 91, further comprising an advancing step to advance the recording medium between each pass.

93. Computer-executable process steps according to claim 91, further comprising a of masking step to mask each of the first and second patterns with a different one of mutually exclusive masking patterns so as to ensure that the same pixel for a pattern is not printed more than once.

94. Computer-executable process steps according to claim 91, wherein the first and second patterns are printed by at least one print head mounted on a print carriage, and further comprising the step of changing a starting location for the print carriage in each pass.

95. Computer-executable process steps according to claim 94, wherein the starting location is changed in correspondence to a distance between peaks of a ringing pattern formed by carriage ramp up speed versus distance.

96. Computer-executable process steps according to claim 95, wherein the change in position for each pass is substantially the same as the distance between ringing patterns divided by the number of passes.

97. Computer-executable process steps according to claim 91, wherein the patterns are patterns for matching density.

98. Computer-executable process steps according to claim 91, wherein the patterns are patterns for calibrating resolution.

99. Computer-executable process steps according to claim 91, wherein the patterns-are patterns for alignment.

100. Computer-executable process steps stored on a computer readable medium, said process steps for printing an image using multiple printing passes, said process steps comprising:

a printing step to print one band of the image at a first printing pass; and a printing step to print another band of the image at a second printing pass;

wherein starting positions of the first and second printing passes are shifted relative to each other in a same printing direction.

101. Computer-executable process steps according to claim 100, wherein the image is printed using an ink jet head which scanningly prints across a recording medium, and wherein the starting positions of the first and second printing passes are selected in correspondence to a ringing pattern of said carriage.

102. Computer-executable process steps according to claim 101, wherein the printing direction is a moving direction of said ink jet head.

* * * * *

UNITED STATES PATENT AND TRADEMARK OFFICE

CERTIFICATE OF CORRECTION

PATENT NO. : 6,297,888 B1
DATED : October 2, 2001
INVENTOR(S) : Noyes et al.

It is certified that error appears in the above-identified patent and that said Letters Patent is hereby corrected as shown below:

Column 9,
Line 25, "pixel" should read -- pixels --.

Column 12,
Line 2, "computing" should read -- Computing --.

Column 21,
Line 21, "on" should read -- one --; and
Line 31, "of" (first occurrence) should be deleted.

Column 22,
Line 15, "patterns-are" should read -- patterns are --.

Signed and Sealed this

Twenty-sixth Day of March, 2002

*Attest:*

*Attesting Officer*

JAMES E. ROGAN
*Director of the United States Patent and Trademark Office*